US006193079B1

(12) United States Patent
Wiemer

(10) Patent No.: US 6,193,079 B1
(45) **Date of Patent: *Feb. 27, 2001**

(54) PRODUCT DISPLAY AND SUPPORT

(75) Inventor: James A. Wiemer, Fox Point, WI (US)

(73) Assignee: DCI Marketing, Inc., Milwaukee, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/301,939

(22) Filed: Apr. 29, 1999

(51) Int. Cl.[7] ..... B42F 7/00
(52) U.S. Cl. ..... 211/59.1; 211/57.1
(58) Field of Search ..... 40/642.01, 642.02, 40/661.08, 666, 617, 657; 248/220.41–220.43, 220.31; 211/59.1, 57.1, 106, 106.1

(56) References Cited

U.S. PATENT DOCUMENTS

| | | | | |
|---|---|---|---|---|
| 4,319,731 | * | 3/1982 | Pfeifer | 248/220.41 |
| 4,351,440 | * | 9/1982 | Thalenfield | 211/57.1 |
| 4,391,375 | * | 7/1983 | Joyce | 211/85.2 |
| 4,540,093 | * | 9/1985 | Merl et al. | 211/59.1 |
| 4,557,064 | * | 12/1985 | Thompson | 40/617 |
| 4,593,824 | * | 6/1986 | Pfeifer | 211/57.1 |
| 4,674,721 | * | 6/1987 | Thalenfield | 211/59.1 |
| 4,703,575 | * | 11/1987 | Diamond | 40/617 |
| 4,801,116 | * | 1/1989 | Blankenship | 40/661.08 |
| 4,850,557 | * | 7/1989 | Valiulis | 211/57.1 |
| 5,236,163 | * | 8/1993 | Valiulis | 248/220.41 |
| 5,348,167 | * | 9/1994 | Jensen | 211/59.1 |
| 5,441,161 | * | 8/1995 | Merl | 211/59.1 |
| 5,577,337 | * | 11/1996 | Lin | 40/642.01 |
| 5,799,428 | * | 9/1998 | Poindexter | 40/617 |
| 5,833,077 | * | 11/1998 | Engel | 211/59.1 |
| 5,860,239 | * | 1/1999 | Thalenfield et al. | 40/642.01 |
| 5,871,115 | * | 2/1999 | Kohn | 211/59.1 |
| 5,901,487 | * | 5/1999 | Thalenfeld et al. | 40/642.01 |
| 5,979,674 | * | 11/1999 | Thalenfeld | 211/57.1 |
| 6,059,124 | * | 5/2000 | Weck et al. | 211/57.1 |

* cited by examiner

*Primary Examiner*—Daniel P. Stodola
*Assistant Examiner*—Jennifer E. Novosad
(74) *Attorney, Agent, or Firm*—Michael Best & Friedrich LLP

(57) ABSTRACT

A product display and support includes substantially parallel elongated tag and product holders. Tile tag holder includes a curved end. A tag clip includes a U-shaped portion including flanges defining a channel and an opening. The tag clip is mounted on the tag support by inserting the curved end into the opening and rotating the clip about the curved portion, thereby causing the curved portion to be received in the channel. The tag clip may be rotated about the curved end to thereby move the clip out of interference with the end of the product holder to allow easy loading of the product holder without removing the clip from the tag holder.

13 Claims, 2 Drawing Sheets

PRODUCT DISPLAY AND SUPPORT

FIELD OF THE INVENTION

The invention relates to product displays. More specifically, the invention relates to a product display that supports products and a product identification tag.

BACKGROUND OF THE INVENTION

Prior art display and support systems typically include a product identification tag disposed near an end of an elongated product support member. The tag usually blocks the end of the elongated member, interfering with loading of products on the support member without removal of the tag.

SUMMARY OF THE INVENTION

The present invention provides a product display and support including an elongated product holder, an elongated tag holder, and a tag clip. The elongated product holder includes a free end for loading products thereon. The elongated product holder and tag holder have straight portions that preferably are arranged in a common plane and extend generally in the same direction. The tag holder portion also includes a curved portion extending generally perpendicular to the tag holder straight portion of the tag holder, and, preferably, to the plane of the straight portions. The tag clip includes a U-shaped portion having at least two pairs of flanges extending toward each other to define a channel in the U-shaped portion. The flanges of one pair terminate in spaced relation from the flanges in the other pair to define an opening between the flanges to allow the curved portion of the tag holder to be inserted into the channel.

Preferably the elongated product and tag holders are cylindrical in cross section. Preferably, the product display and support includes a base member to which the elongated product and tag holders are connected. Preferably, the product holder also includes an end portion spaced from the base member that extends upwardly toward the tag holder. The product holder is sufficiently flexible to allow flexing thereof when product is loaded thereon.

DETAILED DESCRIPTION

Figure 1:
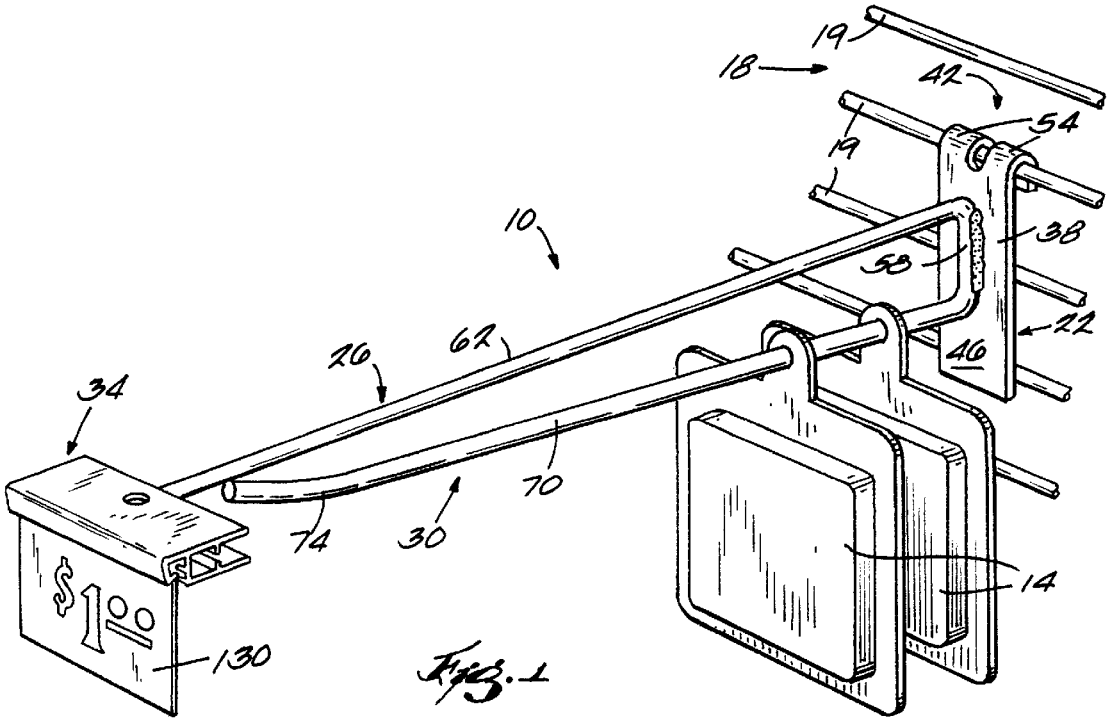
FIG. 1 is a perspective view of a product display and support embodying the invention.

FIG. 1 illustrates a product display and support 10 for supporting items or products 14 on a display unit. In the illustrated embodiment, the product display and support 10 is connected to a display grid 18 made up of rods 19, which can be constructed and arranged as disclosed in U.S. Pat. No. 5,769,248 assigned to the assignee of this application. The product display and support 10 includes a base member 22, a tag support bar 26 (e.g., a bar for supporting a UPC tag), a product support bar 30, and a tag clip 34 (e.g., a clip for a UPC tag). In the illustrated embodiment, all components of the product display and support 10 are made of steel. However, the product display and support could also be made of aluminum, or another material having the requisite flexibility and rigidity. In the illustrated embodiment, the tag clip 34 is made of clear plastic.

The base member 22 includes a plate portion 38 and a mounting portion 42. The plate portion 38 is generally rectangular in the illustrated embodiment, with the long dimension disposed generally vertically. The vertical length of the plate portion is such that it spans more than one rod 19 of the grid. Three rods are spanned in the illustrated preferred embodiment. The plate portion 38 includes a front surface 46 and an opposite rear surface. The front surface 46 defines a plane. The plate portion 38 may also be provided in a variety of other shapes that provide enough surface area to allow the tag support bar 26 and the product support bar 30 to be connected to the front surface 46, as described below.

The mounting portion 42 in the illustrated embodiment includes a pair of hook members 54 that are adapted to hook over a grid rod 19. The mounting portion 42 may also be provided in other shapes. For example, the mounting portion 42 may be provided as a single hook member.

In the illustrated embodiment, the tag support bar 26 and the product support bar 30 are formed from a single cylindrical-shaped bar that is suitably formed to provide a base or connecting web portion 58. The base 58 is connected to the front surface 46 of the plate portion 38 of the base member 22. In the illustrated embodiment, the connecting portion 58 is welded to the front surface 46 of base member 22. Alternatively, the tag support bar 26 and the product support bar 30 may be separate components that can be separately welded to the base member 22.

A straight portion 62 of the tag support bar 26 extends away from the front surface 46 in a direction generally perpendicular to the plane of the front surface 46, and the display grid 18. A curved portion 66 is provided at the distal end of the straight portion 62, and includes a bend 67 joining the curved portion 66 and straight portion 62. In the illustrated embodiment, the curved portion 66 defines an angle of about 90° with respect to the straight portion 62, and extends in a generally horizontal direction and in a common horizontal plane as straight portion 62. As described in further detail below, the tag clip 34 is connected to the curved portion 66 of the tag support bar 26.

The product support bar 30 includes a holding portion 70 and a retention portion 74. The holding portion 70 extends away from the front surface 46 of the base member 22 in a common vertical plane with the straight portion 62 of the tag support bar 26 and in the same direction as the tag support bar. The horizontal plane defined by straight portion 62 and end 68 is at 90° to the vertical plane defined by straight portion 62 and product support bar 30. The retention portion 74 is angled upwardly with respect to the holding portion 70 of the product support bar. In the illustrated embodiment, the angle between the holding portion 70 and the retention portion 74 is obtuse. The retention portion 74 extends at an angle to the horizontal (the plane defined by portions 62 and 66 if reference is needed) and angles upwardly toward the tag support bar 26. When products 14 are supported by the product support bar 30, they are held on the holding portion 70, and retained from sliding off the product support bar 30 by the angle of the support to the horizontal and by retention portion 74.

Because of the configuration and length of the product support 30, it exhibits flexibility generally about its connection to base member 22. The product support 30 can be flexed downwardly to assist in placing product 14 onto the support. In the preferred embodiment, the length of support bar 30 is 18" and its diameter is 0.281".

Figure 2:
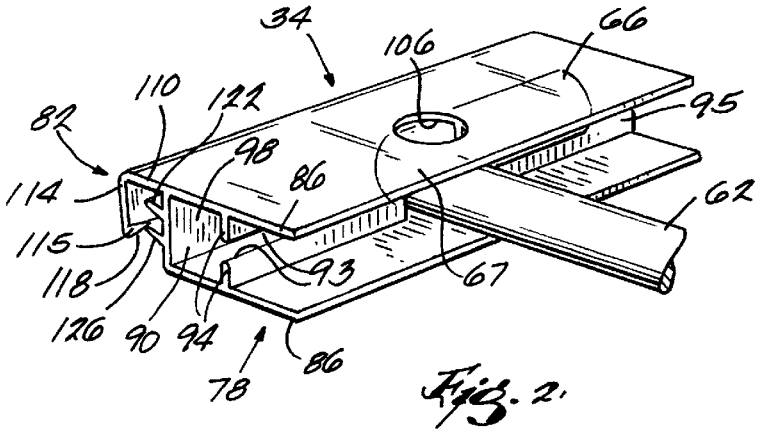
FIG. 2 is a perspective view of the curved end of the tag holder and the tag clip.
Figure 3:
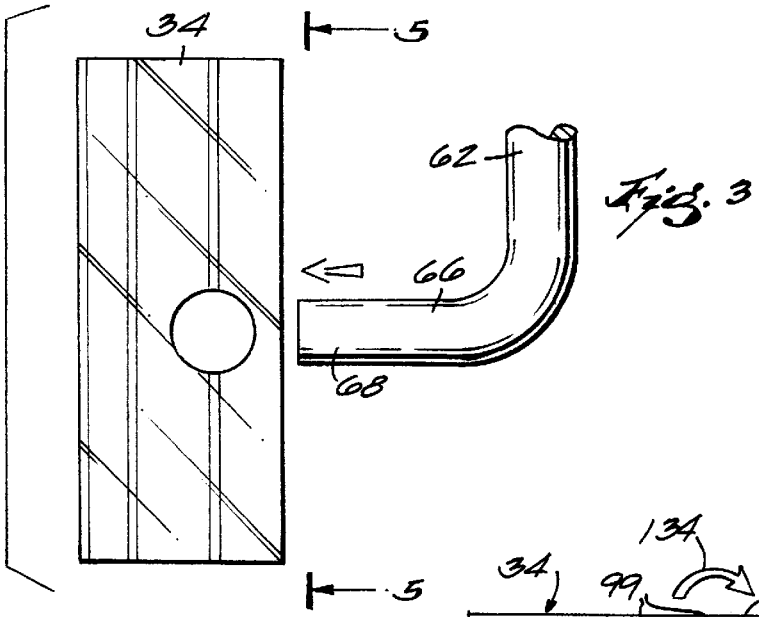
FIG. 3 is a top plan view of the curved end of the tag holder and the tag clip.
Figure 4:
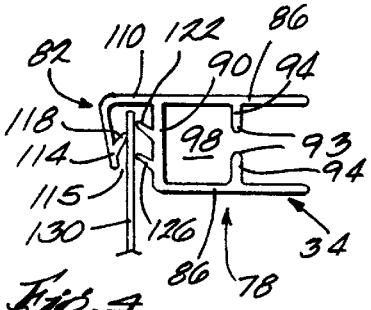
FIG. 4 is an end elevational view taken along line 4—4 in FIG. 3.

The tag clip 34 is best illustrated in FIGS. 2 and 4. The clip 34 includes a U-shaped portion 78 and an L-shaped portion 82 projecting in opposite directions from a common wall 90. The U-shaped portion 78 includes opposite walls 86 and the common connecting wall 90. Two pair of flanges 94 and 95 extend inwardly from each of the opposite walls 86, and, with the connecting wall 90, define a channel 98 extending the length of the clip and into which the curved portion 66 of the tag support bar 26 is received. More specifically, flanges 94 are in line but terminate in ends 93 which are spaced apart. Identically, flanges 95 terminate in spaced ends 97. In addition, the inner ends 99 and 101 of flanges 94 and 95, respectively, are relatively spaced to provide a defined opening 102. The opening 102 may be cut, for example, by drilling through the walls 86 and the flanges 94, 95, resulting in the opening 106 (FIG. 3) in the walls 86. Otherwise, the opening 102 may be formed during the forming process of the clip with a pin inserted through the walls 86. The channel 98 is elongated and has a longitudinal axis which is perpendicular to the plane of the paper in FIG. 4. The flanges 94 and 95 are also elongated and parallel to that longitudinal axis. The opening 102 allows the end of the curved portion 66 to be inserted into the channel 98 as will be described hereinafter. In the illustrated embodiment, the clip 34 is an injection molded part and the walls, openings and other structured parts thereof are formed in the injection molding process.

Figure 5:
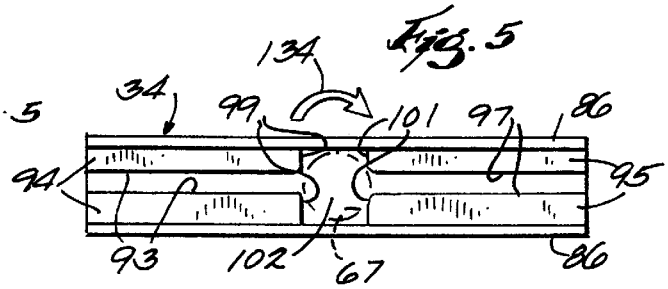
FIG. 5 is a view taken along line 5—5 in FIG. 3.
Figure 7:
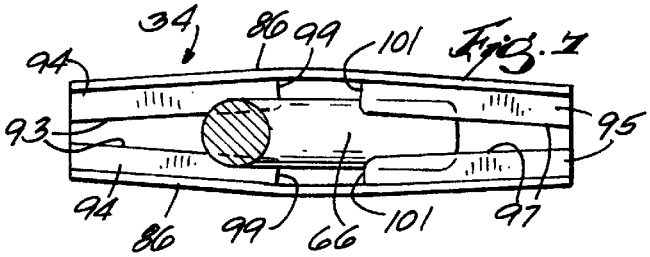
FIG. 7 is a view taken along line 7—7 in FIG. 6.
Figure 6:
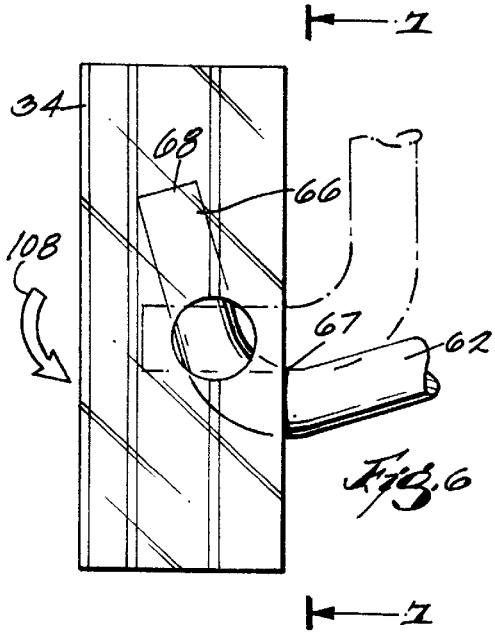
FIG. 6 is a top plan view of the curved end of the tag holder being inserted into the tag clip.
Figure 8:
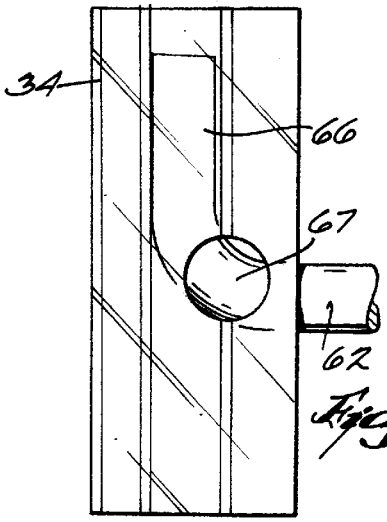
FIG. 8 is a top plan view of the curved end of the tag holder fully inserted into the tag clip.

The tag clip 34 is connected to the tag support bar 26 by first inserting the end 68 of the curved portion 66 into the channel 98 through the opening 102 (FIG. 3). With reference to FIG. 6, after the end 68 of the curved portion 66 is inserted into the channel 98 (the dotted line shown in FIG. 6), the clip 34 is rotated relative to end 68 in the direction of arrow 108 to assume the position illustrated in full lines in FIG. 6 which corresponds to the relative positioning of the clip and curved portion illustrated in FIG. 7. This movement causes the flanges 94 to separate initially and is continued until the entire length of curved portion 66 is inserted into the channel 98. As seen in FIG. 7, the U-shaped portion 78 opens slightly while the clip is rotated to accommodate the curved portion 66, and then U-shaped portion 78 snaps around the periphery of bend 67 between the straight portion 62 and the curved portion 66 after the curved portion 66 is fully received in the channel 98. The curved portion 66 is thus received securely in the opening 102 with the opposed ends 99 and 101 of flanges 94 and 95 in close proximity to the periphery (circumference) of the curved portion or, specifically bend 67 when the clip 34 snaps into place (FIGS. 2, 5 and 8).

Referring now to FIGS. 2 and 4, the L-shaped wall 82 includes a horizontal portion 110 and a vertical portion 114. The horizontal portion 110 is connected to the U-shaped portion 78 through common connecting wall 90 and in line with the upper wall 86 in the drawing. The vertical portion 114 terminates in a free end 115. A first pressure member or barb 118 extends inwardly from the vertical portion 114 toward the wall 90 from adjacent the free end 115. The first pressure member 118 and the vertical portion 114 define an acute angle therebetween. Second and third pressure members or barbs 122, 126 extend from the connecting wall 90 of the U-shaped member 78 toward the vertical portion 114 of the L-shaped wall 82. The second and third pressure members 122, 126 define acute angles with respect to the connecting wall 90 of the U-shaped member 78. The first pressure member 118 extends into the space between the second and third pressure members 122, 126 and can overlap those second and third members when no tag is inserted (FIG. 2).

A tag 130 is easily inserted and removed from the tag clip 34 by sliding the tag 130 between the vertical portion 114 of the L-shaped wall 82 and the connecting wall 90 of the U-shaped portion 78 and between the opposed barbs 118 and 122, 126. While the tag 130 is disposed between the vertical portion 114 of the L-shaped wall 82 and the connecting wall 90 of the U-shaped portion 78, the tag 130 is held in place by the first, second, and third pressure members 118, 122, 126.

Clearance is easily provided for loading products 14 onto the product support bar 30. This is done by reversing the previously described procedure. More particularly, the tag clip 34 is rotated, or slid out along the length of curved portion 66 (the reverse of what is shown in FIG. 6). This motion is continued until the bend 67 is clear of opening 102 and only a portion of curved portion 66 is in opening 102 (as shown in phantom in FIG. 5 and FIG. 6). As shown by the phantom lines in FIG. 6 and by inference in FIG. 5, the curved portion 66 is held securely in opening 102 by ends 99 and 101 which closely fit around the periphery (circumference) of the curved portion. As illustrated by the phantom lines in FIG. 5, which phantom lines can be taken as representing the cross section of curved portion 66, the ends 99 and 101 are in engagement with the periphery of the curved portion 66 after a portion of the curved portion has been removed from the channel 78, the phantom line showing in FIG. 6. It (the tag clip) can then be rotated in a vertical plane, as indicated by arrow 134 in FIG. 5 to clear the tag 130 from the end of product support 30 for insertion of product. The engagement of ends 99 and 101 with the periphery of curved portion 66 prevents movement, other than rotation, of the tag clip in a vertical plane. In other words, the curved portion is held against movement parallel to the longitudinal extension of channel 98 and the flanges 94 and 95. After all product is loaded, the clip 34 is again rotated or slid on the curved portion 66 to return to the orientation of FIG. 1. In this regard, the tag clip 34 may be moved from interference with product loading without removing the clip 34 from the tag support 26.

Although particular embodiments of the present invention have been shown and described, other alternative embodiments will be apparent to those skilled in the art and are within the intended scope of the present invention. Thus, the present invention is to be limited only by the following claims.

What is claimed is:

1. A product display and support comprising, an elongated product holder having a free end on which a plurality of product pieces can be inserted for suspension on said elongated product holder, an elongated tag holder member positioned above said product holder, said tag holder member connected to said product holder and having a straight portion extending generally in the same direction as said product holder, said tag holder member having a curved end portion extending generally perpendicular to said straight portion, a tag clip supported on said tag holder member and movable between an interference position in which said tag clip extends generally transverse to said straight portion of said tag holder member, and a clearance position in which said tag clip extends generally parallel to said straight portion and in which said tag clip is rotatable in a vertical plane about said curved end portion of said tag holder member, said tag clip including:

an elongated channel portion defined by first and second spaced elongated walls connected by a third wall to define a U-shaped in cross section configuration to said channel, said channel having opposite exterior ends and a central portion, and two flanges extending from each of the first and second elongated walls towards the other of the elongated walls, each flange including a flange end, four of said flange ends defining an opening into said channel such that when said tag clip is in said clearance position, all four of said flange ends simultaneously and by direct contact engage the periphery of said curved end portion so that said curved end portion is receivable in said opening and said curved end is movable into and out of said channel to support said tag clip on said elongated tag holder member and when said curved end portion is in said opening, said tag clip is rotatable about said curved end portion and said flange ends hold said curved end portion against lateral movement in a direction parallel to said first and second elongated walls.

2. The product display and support of claim 1, wherein said elongated product holder is in the form of an elongated rod member having a cylindrical cross section, said tag holder member is in the form of an elongated rod member having a cylindrical cross section and arranged in a common plane with said elongated product holder except for said curved end portion which extends laterally from said common plane, and said product holder and said tag holder member are connected to a base member.

3. The product display and support of claim 2, wherein said product holder has a relatively straight portion and has an end portion which extends, relative to said straight portion, at an angle upwardly toward said tag holder member, and said product holder has sufficient flexibility to allow flexing thereof when product is being inserted thereon.

4. The product display and support of claim 1, wherein said tag clip is supported by said tag holder member for movement between a first position in which said tag clip supports a tag in general alignment with said product holder so as to interfere with insertion of product pieces onto the product holder, and a second position displaced from said first position and in which product pieces may be inserted onto the product holder.

5. The product display and support of claim 1, wherein said tag clip includes a generally L-shaped portion adapted to hold a tag against said third wall of said tag clip.

6. The product display and support of claim 5, wherein said L-shaped portion includes at least one pressure member extending toward said third wall of said tag clip adapted to facilitate holding a tag against said third wall.

7. The product display and support of claim 6, wherein said third wall includes at least one pressure member adapted to facilitate holding a tag between said L-shaped portion and said third wall.

8. The product display and support of claim 5, wherein said elongated product holder and said tag holder member are in the form of rods generally circular in cross section with a diameter of 0.281" and said product holder is 18.0" long and said tag holder is 2.0" long.

9. A product display and support comprising:

an elongated product holder member for supporting a plurality of product pieces;

an elongated tag holder member positioned generally above said product holder member and joined to said product holder member, said tag holder member having a straight portion extending in a common plane with said product holder member, and a curved end portion extending generally perpendicular to said straight portion; and a tag clip supported on said tag holder member and movable between an interference position in which said tag clip extends generally transverse to said straight portion of said tag holder member, and a clearance position in which said tag clip extends generally parallel to said straight portion and in which said tag clip is rotatable in a vertical plane about said curved end portion of said tag holder member said tag clip including an elongated generally U-shaped channel portion at least partially defined by first, second, and third walls, and by a flange member extending from each of said first and second walls, portions of said flanges at least partially defining an opening facilitating the insertion of an end of said tag holder member into said channel, said portions of said flanges simultaneously engaging by direct contact said curved end portion of said tag holder member when said tag clip is positioned in said clearance position.

10. The product display and support of claim 9, further comprising a base member having an attachment portion adapted to attach the product display and support to a support grid, said product holder member and said tag support member being mounted to said base member.

11. The product display and support of claim 9, wherein each of said product holder and tag support members includes a cylindrical portion having a generally circular cross-section.

12. The product display and support of claim 9, wherein said tag clip is supported by said tag holder member for movement between a first position in which said tag clip supports a tag in general alignment with said product holder so as to interfere with insertion of product pieces onto the product holder member, and a second position displaced from said first position and in which product pieces may be inserted onto the product holder member.

13. The product display and support of claim 12, wherein said tag clip is rotatable between said first and second positions.

* * * * *